340-566 SR
1/13/87 OR 4,636,775

United States Patent [19]

Burgess et al.

[11] Patent Number: 4,636,775

[45] Date of Patent: Jan. 13, 1987

[54] SENSOR FOR AN ALARM SYSTEM

[75] Inventors: James P. Burgess, Camarillo; John C. Echols, Ventura; Thomas A. Walker, Summerland, both of Calif.

[73] Assignee: Essex-Tec Corporation, Carpinteria, Calif.

[21] Appl. No.: 599,720

[22] Filed: Apr. 12, 1984

[51] Int. Cl.[4] ..... G08B 13/00

[52] U.S. Cl. ..... 340/566; 340/65

[58] Field of Search ..... 73/654; 310/329, 355; 340/566, 63, 64, 65, 689

[56] References Cited

U.S. PATENT DOCUMENTS

| | | | |
|---|---|---|---|
| 3,631,271 | 12/1971 | Shimada | 310/329 X |
| 4,211,951 | 7/1980 | Jensen | 310/329 |
| 4,311,891 | 1/1982 | Faust | 340/65 X |
| 4,358,750 | 11/1982 | Webster | 340/566 X |
| 4,382,203 | 5/1983 | Tribby et al. | 310/355 |

*Primary Examiner*—Charles A. Ruehl

*Assistant Examiner*—Jeffery A. Hofsass

*Attorney, Agent, or Firm*—Learman & McCulloch

[57] ABSTRACT

An alarm condition sensor for triggering a signal incorporated in an alarm system and adapted to be mounted on a motor vehicle or other object to protect it against burglary, theft, tampering, or the like. The sensor comprises a sensing mass mounted atop a deformable substrate equipped with piezoelectric material operable to generate a signal voltage upon stressing or deformation of the substrate in response to forces effecting relative movement between the mass and the substrate. The sensor may be mounted on a cantilever spring support which enables the mass to move and thereby stress the substrate and generate a signal voltage. Voltage sensitive means responsive to voltages generated by the piezoelectric material is operable to trigger the alarm system. The sensitivity of the sensor is adjustable to vary the threshold value of the voltage operable to activate the alarm.

16 Claims, 6 Drawing Figures

SENSOR FOR AN ALARM SYSTEM

BACKGROUND OF THE INVENTION

This invention relates to an alarm condition sensor device adapted to be mounted on an object to be protected against burglary, theft, tampering, and the like. The sensor device is particularly adapted for use with an automotive vehicle, but its uses are virtually unlimited. The sensor is coupled to an alarm circuit and is operable to sense acts incidental to attempted burglary, theft, tampering, and the like and initiate the operation of an alarm signal. The sensor is sensitive to vibratory, inertial, and other motion forces applied directly to a vehicle or the like, but is relatively immune to the effects of passing vehicles, street noises, and the like.

Various sensing and triggering devices for vehicular and other alarm systems have been proposed heretofore, some of which have been responsive to vibration, movement, and other forces incidental to attempts to burglarize, tamper with, or move the vehicle. One of the undesirable characteristics of some of the known devices is the tendency to trigger the alarm falsely in response to the passage nearby of heavy vehicles or as a result of street noises and the like.

A principal object of the invention is to provide a vehicle alarm system and sensor therefor which overcomes the disadvantages of previously known systems and sensors.

SUMMARY OF THE INVENTION

A sensor constructed according to the invention and operable to trigger an alarm system comprises deformable piezoelectric material fixed to a deflectable substrate. The piezoelectric material is operable to generate a signal voltage upon deflection of the substrate in response to the occurrence of an alarm condition and activate an alarm. A sensing mass rests upon the substrate that may be carried at the free end of a resilient cantilever support which can deflect in response to vibratory, inertial, or other motion forces to which the vehicle is subjected. The sensing mass is capable of limited movement relative to the substrate. If the force to which the vehicle is one which causes relative movement between the sensing mass and the substrate, the movement of the sensing mass relative to the support results in stressing of the substrate and the piezoelectric material and generation of the alarm signal voltage. The substrate and sensing mass are located within a housing which maintains the mass in proper position and limits its movement relative to the substrate.

Voltage sensitive means responsive to voltage signals generated by stressing of the substrate and the piezoelectric material provides a step function output upon the voltage's exceeding a threshold value and triggering of the alarm circuit. The alarm system includes electronic switch means operable to effect operation of an alarm signal such as a horn, siren, radio transmitter, or the like. The alarm signal circuitry may be incorporated in or located externally of the sensor housing.

The voltage sensitive means may comprise an integrated circuit operational amplifier to which the signal voltage is fed via appropriate electronic components and, preferably, a gain control means for controlling the sensitivity of the alarm circuit. An LED or other visible indicator is connected to the operational amplifier to facilitate adjustment of the sensitivity to a desired level.

THE DRAWINGS

DETAILED DESCRIPTION OF THE INVENTION

Figure 2:
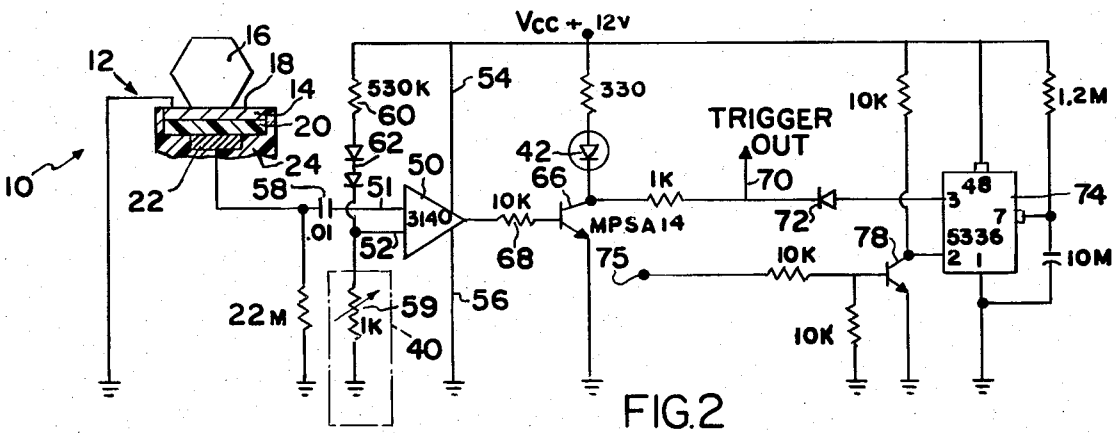
FIG. 2 is an electrical schematic diagram of an alarm system circuit according to one embodiment of the invention.
Figure 1:
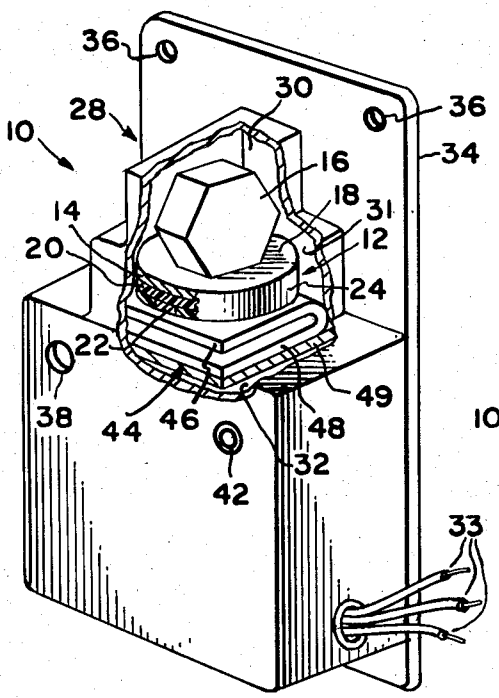
FIG. 1 is an isometric view, partially broken away, illustrating the alarm condition sensor device of the present invention.

An alarm sensor constructed in accordance with the embodiment illustrated in FIGS. 1 and 2 is designated generally by the reference character 10. The sensor comprises an actuator 12 have a thin, deflectable, springy substrate 14 formed of electrically conductive metal having a flat, exposed, upper surface 18. To the lower surface of the substrate is physically and electrically bonded a coating 20 of piezoelectric material such as is described in U.S. Pat. No. 4,190,785 issued Feb. 26, 1980. Alternatively the substrate may be electrically bonded in a conventional manner to a known piezoelectric wafer or body. In either case an electrode 22 is electrically connected to the piezolectric material 20. The piezoelectric material 20 and the electrode 22 may be encapsulated in an epoxy resin or the like as is indicated by the reference character 24.

As is described in more detail in the aforementioned U.S. Pat. No. 4,190,785, deflection of the substrate 14 will stress and deform the piezoelectric material 20 and cause the latter to generate a signal voltage. In general, the deflectability of the substrate 14 is inversely proportional to its thickness and the strength of the voltage pulse generated by the piezoelectric material is directly proportional to the extent and rapidity of the deflection of the substrate.

The sensor includes a mass 16 which, in the embodiment of FIG. 1, comprises a multi-faceted body having a plurality of relatively small area, flat surfaces one of which seats on the upper surface 18 of the substrate 14. The width of the mass is uniform, but the presence of the multiple side surfaces enables those portions of the body at opposite ends of the surface seated on the substrate to overhang such surface and thereby concentrate the weight of the mass over a relatively small area.

The sensing mass 16 is generally free to move, within limits, relative to the actuator 12. Limiting means is provided to ensure concentrating the weight of the mass 16 adjacent the center of the substrate 14 and to restrict the movement of the mass. The limiting means comprises a housing 28 having walls defining a generally rectangular compartment 30 in which the sensing mass 16 is accommodated. The width of the compartment is a few millimeters greater than the width of the mass 16, thereby enabling the latter to move transversely of the compartment. The length of the compartment is greater than the corresponding diametral dimension of the mass, thereby enabling the mass to move longitudinally of the compartment. The height of the compartment is greater than that of the mass, thereby enabling the mass to move vertically relative to the substrate. Thus the mass is movable relatively to the substrate in horizontal and vertical planes.

Any movement of the mass 16 relative to the substrate 14 deflects the latter an amount sufficient to generate a signal voltage. Since the mass 16 is movable relatively to the substrate in both the horizontal and vertical planes, a signal voltage will be generated during motion of the mass 16 relative to the substrate in any one of three orthogonal axes.

Below the compartment 30 the housing walls form another, larger compartment 31 within which the actuator 12 is accommodated. Below the compartment 31 is a third compartment 32 within which an alarm circuit is positioned. The alarm circuit has electrically conductive leads 33 extending outwardly of the housing for connection to a battery or other energy source and to a signaling device such as a horn, siren, radio transmitter, or the like. If desired, however, the alarm circuit may be located at some point remote from the housing 28 and connected to the latter by suitable wiring.

The housing 28 preferably includes a mounting bracket 34 provided with apertures 36 for the accommodation of screws or the like by means of which the housing may be mounted within the engine compartment or other suitable place on a vehicle or other object to be protected. The housing should be so mounted that the upper surface 18 of the substrate is horizontal.

If the alarm circuit is located within the housing 28, the latter may be provided with an aperature 38 permitting access to a gain control 40, described in more detail hereinafter, enabling the sensitivity of the sensor 10 to be adjusted to a desired level. An LED or other indicating device 42 provides a visual indication when the sensor 10 is actuated, regardless of whether the sensor is connected to an alarm.

In the embodiment illustrated in FIG. 1, the sensor 10 is mounted on a spring support designated generally by the reference character 44. The support 44 is located within the housing compartment 31 and comprises a cantilever leaf spring which, for compactness, is bent through approximately 180° to a generally U-shaped configuration. The spring has a first leg 46 supporting the actuator 12 and a second leg 48 seated on a partition 49 forming part of the housing 28. The spring increases the sensitivity of the sensor to vertical movement relative to the object on which the housing is mounted.

The sensor 10 includes an integrated circuit operational amplifier 50, such as a CA3140 amplifier, having a non-inverting input 51 and an inverting input 52. The amplifier 50 further has a power connection 54 ($V_{cc}$) and a ground 56 as illustrated. The electrode 22 is connected to the non-inverting input 51 of the amplifier 50 via a capacitor 58. The gain control 40 may comprise a variable resistor 59 connected between the inverting input 52 and ground. Gain may also be controlled through a temperature compensating network comprising a series connected resistor 60 and diode pair 62 similarly connected with the inverting input 52 of the amplifier 50.

With the exception of the gain control 40, all of the aforementioned components forming the operational electronics of the amplifier 50 may be encapsulated with the parts 14, 20, and 22 of the actuator 12, so as to be mounted for movement therewith on the leg 46 of the support 44. The gain or sensitivity control 40 may be mounted on the housing 28 so as to be adjustable through the aperture 38 and be connected with the encapsulated amplifier 50 by means of flexible electrical leads.

The sensor circuitry may be of any one of a number of designs adapted to trigger an alarm circuit. For example, the circuitry shown in FIG. 2 includes a transistor switch 66 connected to the output of the amplifier 50 through a base resistor 68 in circuit with a trigger indicator means comprising the LED 42 which is illuminated when the transistor switch 66 is conductive. When the transistor switch is conducting, the trigger lead 70 will be driven low. An exit delay to the trigger lead may be provided by means of a diode 72 and an integrated circuit timer 74 connected to an alarm set input lead 75 via an inverting transistor switch 78 and associated circuit elements as shown.

The trigger lead 70 shown in FIG. 2 may be connected to any one of a number of alarm systems or circuits to provide triggering thereof when the exit delay period has expired after operation of the trigger set switch and upon the occurrence of movement or vibration such as to operate the sensor 10.

Figure 3:
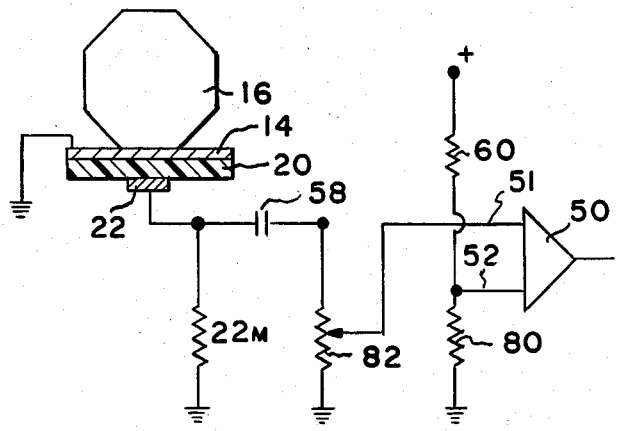
FIG. 3 is a partial schematic diagram illustrating a modification of the circuit of FIG. 2.

A somewhat modified sensor circuit, fragmentarily illustrated in FIG. 3, may be substituted for that shown in FIG. 2. In the modified circuit the variable resistor 59 is replaced by a fixed resistance 80, the diode pair 62 is eliminated, and a variable resistance gain control 82 is connected to the input 51 of the amplifier 50. Except for the connections leading to the amplifier input, the sensor circuits shown in FIGS. 2 and 3 are the same.

Figure 4:
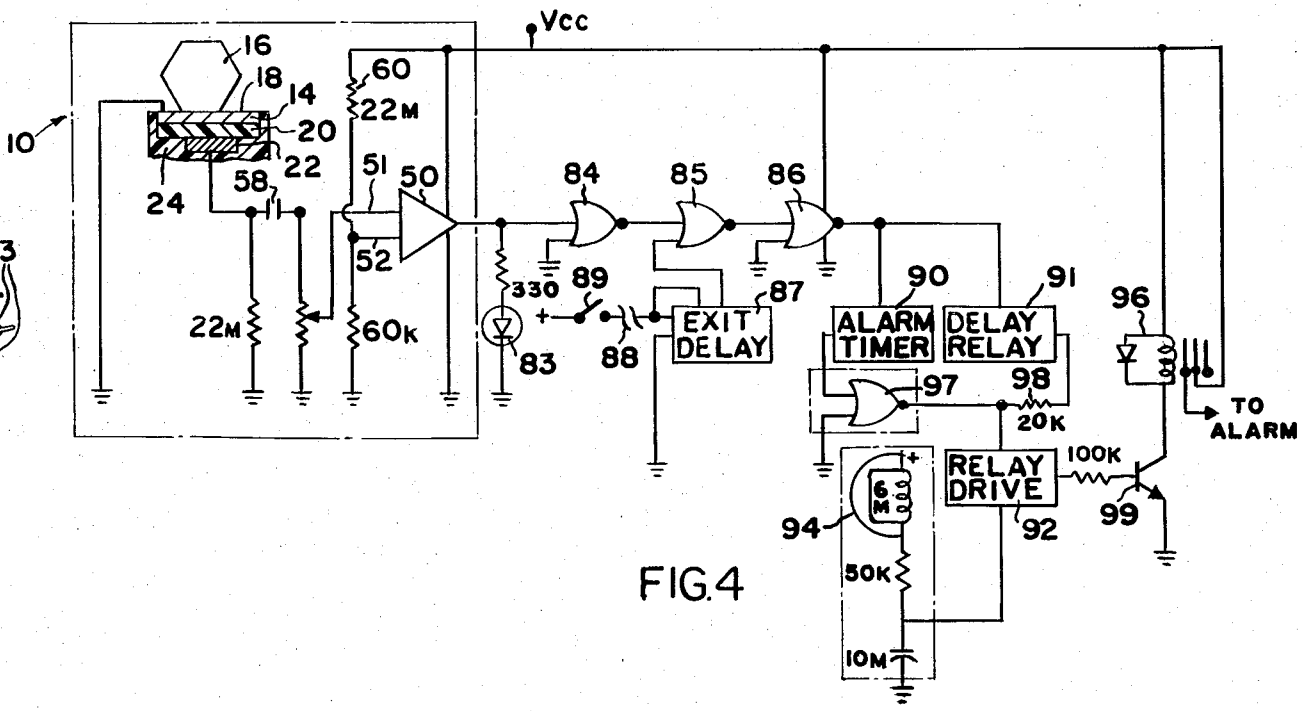
FIG. 4 is a schematic diagram illustrating a modified alarm circuit.

FIG. 4 discloses a combined sensor and alarm circuit and wherein the sensor circuit from and to the left of the amplifier 50 is the same as that shown in FIG. 3. The alarm circuit of FIG. 4 includes a series of solid-state logic devices and additional timing devices, and the output of the operational amplifier 50 is connected to an indicating LED 83. Also connected to the output of the amplifier 50 is a series of NOR gates 84, 85, and 86. The second input of the first gate 84 is connected to ground and, therefore, the gate 84 functions as an inverter. An exit delay timer 87 having an alarm set input 88 connected with an alarm set switch 89 is connected, along with the output of the first gate 84, to the input of the second gate 85. The third gate 86, having its second input grounded, is connected to the output of the first gate 84 so as again to provide inversion.

An alarm timer 90 is connected to the triggering output of the gate 86 to prevent the alarm from sounding indefinitely following triggering and causing the vehicle's battery to be drained with the loss of alarm protection and other annoyances attendant thereto. Following a triggering incident, the alarm timer 90 will permit the alarm to sound for a desired period of time, such as one minute, following which the alarm sounding will cease and the device will reset, restoring protection.

An entry delay timer 91 and a relay drive 92 are provided for selectively providing either an oscillating or steady relay drive and a corresponding intermittent or steady alarm signal Whether the relay drive is oscillating or steady depends upon the input resistance thereto. To enable this to be set by the installer, a jumper wire 94 is provided and which, when used, provides for an oscillating relay drive and, when not used, provides for a steady relay drive. An output relay 96 is connected via a transistor switch 99 to the output of the relay drive 92 to actuate an alarm such as a horn, siren, radio transmitter, or the like. The alarm timer 90 and the entry delay timer 91 also are connected to an inverting gate 97, and between the latter and the delay relay is a current limiting resistor 98 to protect the gate during the time that the entry delay timer overrides the alarm timer.

The materials and physical characteristics of the sensing mass and the substrate on which it is supported should, in all cases, be such that movement of the mass in any direction relative to the substrate causes the latter to flex. Such flexure will be transmitted to the piezoelectric member which should be sufficiently thin as to flex and generate an electrical pulse capable of being amplified to an extent sufficient to operate the system. Suitable sensors have been constructed utilizing a steel mass of about 150 g. and a stainless or nickel plated steel substrate having a thickness of between about 2.5 and 4 mm. and a diameter of about 19 mm.

Figure 5:
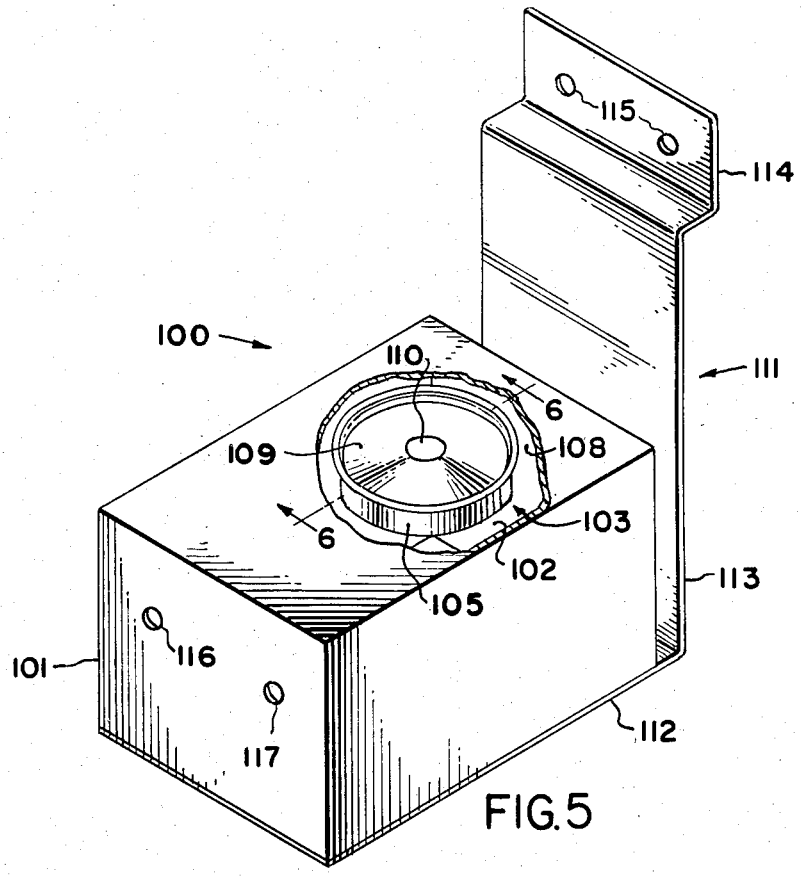
FIG. 5 is an isometric view of a modified sensor.
Figure 6:
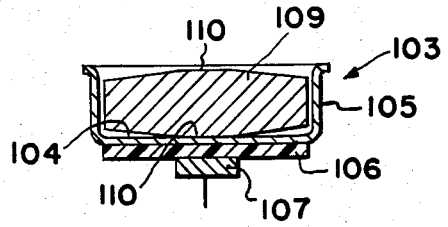
FIG. 6 is a sectional view taken on the line 6—6 of FIG. 5.

FIGS. 5 and 6 illustrate a modified sensor 100 having a housing 101 the walls of which define a chamber 102. The chamber 102 accommodates a cylindrical, upwardly open, electrically conductive, dish-shaped member 103 having a thin, flat bottom or substrate 104. Upstanding from the substrate 104 is an annular wall 105. A coating or body 106 of piezoelectric material is electrically and physically bonded to the lower surface of the substrate 104 and an electrode 107 is electrically bonded to the coating. The member 103 is supported with its bottom in a horizontal position by means of a partition 108 formed of insulating material that is fixed to one wall of the housing 101 and projects into the chamber 102. If desired, the electrical circuitry also may be accommodated in the chamber.

The member 103 receives a sensing mass 109 of cylindrical configuration, but at least one, and preferably both, of its sides is frustoconical in shape. This construction provides a central, flat surface 110 of relatively small area on the lower side of the mass and which seats upon the substrate 104. The diameter of the mass is a few millimeters less than that of the member 103 and the thickness of the mass is a few millimeters less than the height of the wall 105. The mass, therefore, is capable of limited movement relative to the substrate in all directions parallel thereto and it also is movable vertically relatively to the substrate.

A bracket 111 has a cantilever leg 112 on which the housing may be fixed and a second leg 113 having an offset portion 114 adjacent its free end provided with apertures 115 through which screws may pass for mounting the bracket in a suitable place on the vehicle or other object to be protected.

The housing 100 has suitable apertures 116 and 117 for access to the indicator 83 and the sensitivity adjusting potentiometer 82.

In each of the disclosed embodiments of the sensor the mass has a relatively small area surface which engages the respective substrate, whereas other portions of the mass overhang such surface and extend toward, but terminate short of the chamber in which the sensor is accommodated. This construction enables the weight of the sensing mass to be concentrated near the center of its associated substrate where the deflectability thereof is greatest. Thus, each of the sensing masses may deflect its associated substrate and stress the piezoelectric material in response to very light taps on the vehicle.

Although the sensor may be operable to initiate operation of an alarm in response to very light forces, the sensitivity of the apparatus may be adjusted by manipulation of the sensitivity control 40 or 82. Further, for an alarm to be initiated, there must be relative movement between the sensing mass and its substrate in an amount sufficient to flex the latter. Thus, a light force applied to the vehicle, such as by the opening or closing of a door, removal of a wheel cover, or the like will be sufficient to cause deflection of the substrate and energization of the circuitry. However, more gently applied forces, such as those resulting from the normal passage of nearby vehicles, do not cause relative movement between the sensing mass and its substrate because, in this instance, it is the vehicle body which sways and the housing containing the sensing mass moves with, rather than relative to, the body. For the same reason, the sensor is not energized by accoustical vibrations caused by horns, engine sounds, and other noise. The disclosure is representative of presently preferred forms of the invention, but is intended to be illustrative rather than definitive thereof. The invention is defined in the claims.

What is claimed is:

1. A sensor for initiating operation of an alarm for signaling unauthorized interference with an object, said sensor comprising:

piezoelectric material operable in response to vibration thereof to generate a voltage;

deflectable substrate means supporting said piezoelectric means, said substrate means having a flat, upper surface;

a sensing mass carried by said flat, upper surface of said substrate means for movements relative thereto in each of three orthogonal planes, said sensing mass having a flat face, for seating on said flat upper surface, which flat face has an area substantially smaller than the area of the largest horizontal cross section of said sensing mass;

whereby the weight of said sensing mass upon said upper surface is concentrated thereon under the smaller area of said flat face;

said sensing mass being operable to deflect said substrate and vibrate said piezoelectric means in response to relative movement between said sensing mass and said substrate means in any of said planes;

voltage sensitive means for coupling said piezoelectric material to an alarm circuit for energizing the latter in response to the generation of a voltage of predetermined threshold value by said piezoelectric means; and a housing having walls defining a chamber in which said sensing mass is accommodated, said chamber having a size larger than that of said mass thereby enabling said mass to move relative to said substrate means, said chamber having a size which prevents extreme motion of said mass relative to said substrate means, thereby ensuring that the rest position of said sensing mass is in operative relationship with said substrate means.

2. A sensor according to claim 1 wherein said voltage sensitive means includes an integrated circuit operational amplifier.

3. A sensor according to claim 1 including an alarm circuit operable in response to the generation of said voltage of predetermined threshold value, and wherein said voltage sensitive means includes means for varying said predetermined threshold value.

4. A sensor according to claim 1 wherein said substrate means comprises a springy, electrically conductive metal.

5. A sensor according to claim 1 wherein said piezoelectric material comprises a coating applied to said substrate means.

6. A sensor according to claim 1 including gain control means for varying the sensitivity of said voltage sensitive means.

7. A sensor according to claim 6 wherein said gain control means comprises a variable resistance.

8. A sensor according to claim 1 wherein said voltage sensitive means comprises an integrated circuit operational amplifier, and including visible indicator means connected across the output of said operational amplifier.

9. A sensor according to claim 1 including resilient support means supporting said substrate means, said piezoelectric material, and said mass.

10. A sensor according to claim 9 wherein said support means comprises a cantilever spring.

11. A sensor according to claim 10 wherein said spring is bent between its end to a generally U-shaped configuration.

12. A sensor according to claim 1 wherein said substrate means comprises a dished member having a bottom with a flat upper surface and an upstanding side wall surrounding said flat upper surface.

13. A sensor according to claim 12 wherein said bottom of said dished member has an area greater than that of the largest horizontal cross section of said mass, thereby enabling said mass to move relative to said bottom.

14. A sensor according to claim 13 wherein said mass comprises a body having a frustoconical lower surface.

15. A sensor according to claim 1 including timer means in said alarm circuit operable to deenergize the latter after the passage of a period of time.

16. A sensor according to claim 1 including timer means in said alarm circuit operable alternately to energize and deenergize said alarm circuit.

* * * * *